US005655416A

United States Patent [19]

Mott et al.

[11] Patent Number: 5,655,416

[45] Date of Patent: Aug. 12, 1997

[54] TORSIONAL ABSORBER FOR CAMSHAFT SPROCKETS

[75] Inventors: Philip J. Mott, Dryden; Roger T. Simpson, Ithaca; Kevin Todd, Freeville, all of N.Y.

[73] Assignee: Borg-Warner Automotive, Inc., Sterling Heights, Mich.

[21] Appl. No.: 681,696

[22] Filed: Jul. 29, 1996

Related U.S. Application Data

[62] Division of Ser. No. 437,396, May 9, 1995, Pat. No. 5,579,665 .

[51] Int. Cl.[6] ..... F16F 15/14

[52] U.S. Cl. ..... 74/574; 123/90.31

[58] Field of Search ..... 74/574; 123/90.31, 123/192.1; 474/902, 903; 464/98, 81, 78

[56] References Cited

U.S. PATENT DOCUMENTS 4,254,985 3/1981 Kirschner .

4,317,388 3/1982 Wojcikowski ..... 74/574

4,848,183 7/1989 Ferguson ..... 74/574

5,386,894 2/1995 Barca ..... 74/574 X

*Primary Examiner*—Rodney H. Bonck

*Assistant Examiner*—Mary Ann Battista

*Attorney, Agent, or Firm*—Sidley & Austin; Greg Dziegielewski

[57] ABSTRACT

A vibration damper assembly to absorb vibrations in a camshaft and sprocket system has a sprocket positioned around a camshaft, an inertia ring positioned around the camshaft and adjacent the sprocket, yet capable of moving independently of the sprocket, and a hub member positioned around the camshaft adjacent the inertia ring. Frictional material is interposed between the hub member and a rim portion of the inertia ring whereby the inertia ring and hub member slide with respect to one another along the frictional material to absorb vibrations from the camshaft through heat dissipation.

5 Claims, 4 Drawing Sheets

TORSIONAL ABSORBER FOR CAMSHAFT SPROCKETS

This application is a division of application Ser. No. 08/437,396, filed May 9, 1995, now U.S. Pat. No. 5,570,000.

BACKGROUND OF THE INVENTION

This invention relates to the damping of vibrations in rotating devices. The invention has particular application to camshaft and sprocket assemblies for internal combustion engines.

Engine timing systems typically include an endless chain that drives between a driving sprocket on an engine crankshaft and a driven sprocket on an engine camshaft. The camshaft and sprockets may undergo resonance at certain frequencies. Vibrations from the resonance are often transferred through the system and can significantly increase the load on the system and components, possibly even causing chain breakage. This problem is particularly acute in engine systems with overhead camshafts, because the distance between the sprockets, and hence the length of the chain, is typically substantial and vibration effects are thereby magnified.

Conventional approaches to this problem have focused on reducing rotational perturbation of the crankshaft, by means of internal devices such as counter-rotating balance shafts, Lanchester dampers, and harmonic balancers. External devices such as fluid engine mounts and engine mounts having adjustable damping characteristics have been used. By contrast, the present invention focuses on reducing torsional vibrations of the camshaft.

Some prior art timing systems use a rubber damper piece placed against the sprocket and bolted to the camshaft to absorb vibrations. However, the rubber damper piece tends to fracture from the vibrations. Other timing systems employ a weight that, rather than being bolted to the camshaft, is positioned on the camshaft and held against the sprocket by a Belleville washer. Frictional material is placed at the area of contact between the sprocket and the weight. These systems, while effective, have drawbacks in terms of production, assembly, and durability.

An example of prior damping techniques is found in Wojcikowski, U.S. Pat. No. 4,317,388 issued Mar. 2, 1982. That patent discloses a gear with split damping rings of a diameter slightly smaller than the gear bolted to each side of the gear with a tapered bolt and nut assembly. Tightening of the bolts cams the damping rings outward, producing pressure circumferentially against the rim of the gear and causing tensile stresses on the gear. Additionally, tightening the bolts presses the elastomeric washers associated with the bolt and nut assembly firmly against the web of the gear, which damps the stress wave passing from the rim through the web and into the shaft. In contrast to this prior art structure, the present invention retains the damping piece in place with a hub member or retaining ring, thus obviating the need for bolts and nuts which may loosen. Further, the present invention does not require the precision forming of tapered bolt holes in the damping piece.

Another example of known damping techniques is Funahashi, U.S. Pat. No. 5,308,289 issued May 3, 1994. The damper pulley disclosed therein consists of a pulley joined to a damper-mass member with a resilient rubber member. The pulley and the damper-mass member each have at least two projections, and the projections of the pulley contact the sides of the projections of the damper-mass member. A second resilient rubber member is placed between the contacting projections. Bending vibrations from the crankshaft cause the pulley to vibrate in the radial direction and the first resilient rubber member deforms, causing the dynamic damper to resonate with the pulley and restrain the bending vibrations. Torsional vibrations cause the pulley to vibrate in the circumferential direction. The second resilient rubber member undergoes compression deformation, decreasing the spring force and raising the resonance frequency against the torsional vibrations. The present invention avoids the use of rubber, which has wear problems in use.

Another example of prior damping techniques is Kirschner, U.S. Pat. No. 4,254,98 issued Mar. 10, 1981. That patent discloses a damping ring for rotating wheels that includes a viscoelastic damping material disposed within an annular groove in the surface of the wheel. A metal ring is positioned in the groove on top of the damping material. In operation, the damping material undergoes shear deformation. The invention of Kirschner is particularly applicable to railroad wheels and the attenuation of screeching noise therefrom.

SUMMARY OF THE INVENTION

In an engine timing system, an endless chain connects a driving sprocket on the crankshaft to a driven sprocket on the camshaft. Combustion of fuel in the cylinders forces the pistons downward, causing the rods to turn the crankshaft and the driving sprocket. The rotation of the driving sprocket advances the chain, which turns the driven sprocket and the camshaft. Torsional vibrations of the camshaft may arise at certain R.P.M. levels. To reduce these vibrations, the present invention provides a centrifugal force vibration damper assembly positioned adjacent the driven sprocket along the camshaft. The damper assembly comprises an inertia ring held in a contacting relationship with the driven sprocket by a hub member positioned on the camshaft adjacent the inertia ring. The inertia ring moves independently of the sprocket and hub member.

Rotation of the camshaft assembly causes a gap in the perimeter of the inertia ring to expand, creating greater force against the areas of contact with the hub member. Frictional material placed between the contacting surfaces of the inertia ring and the hub member slows the rotation of the inertia ring and absorbs the torsional vibration energy through heat dissipation.

In a second embodiment, the centrifugal force vibration damper assembly comprises an inertia ring in two halves connected by springs that bias the halves outward to provide a preload force on the frictional material placed between the contacting surfaces of the inertia ring halves and the hub member. Rotation of the assembly produces centrifugal force, spreading the halves apart and increasing the force against the frictional material. By adjusting the preload force and the diameter at which the centrifugal force acts against the frictional material, the centrifugal force vibration damper assembly can be tuned to reduce torsional oscillations at multiple R.P.M. levels.

In a third embodiment, the inertia ring is held against the sprocket by a retaining ring. In this embodiment, the frictional material is interposed between the inertia ring and the sprocket rather than between the inertia ring and a hub member. In other respects, this embodiment functions similarly to the first embodiment.

DETAILED DESCRIPTION OF THE PREFERRED EMBODIMENTS

In an engine timing system, a chain connects a driving sprocket on the engine crankshaft to a driven sprocket on the engine camshaft. In an engine with an overhead cam, the driving sprocket and driven sprocket are a substantial distance apart and therefore, the chain linking them is of significant length. The camshaft and sprockets may undergo resonance at certain frequencies. Vibrations from the resonance are often transferred through the system. The present invention provides unique damper assemblies positioned on the camshaft adjacent the sprocket to reduce vibration. The weighted inertia ring moves independently of the sprocket and acts as a flywheel. Frictional material placed between contacting surfaces of the sprocket and the inertia ring or the hub member and the inertia ring slows the rotation of the inertia ring and damps vibrations through heat dissipation.

Figure 1:
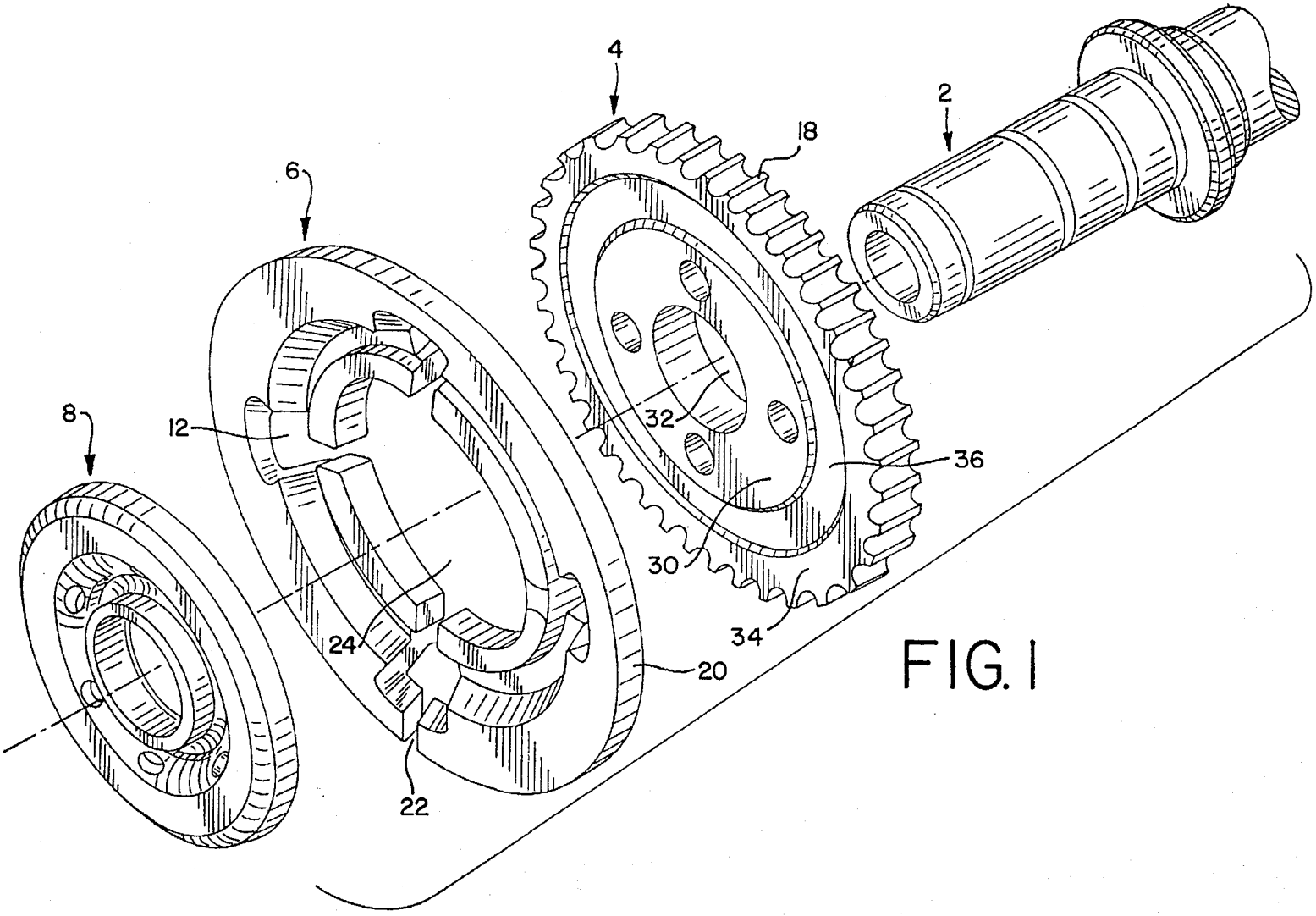
FIG. 1 is an exploded view of a centrifugal force vibration damper assembly comprising a camshaft, sprocket, inertia ring, and hub.

Referring to the drawings, FIG. 1 illustrates a centrifugal force vibration damper assembly composed of a camshaft 2 on which are positioned a sprocket 4, an inertia ring 6 adjacent the sprocket 4, and a hub member 8 adjacent the inertia ring 6. The inertia ring 6 is adapted to move independently of the sprocket 4.

The sprocket 4 has a hub 30 provided with a shaft-receiving opening 32 and a sprocket rim 34. The hub 30 and the sprocket rim 34 are integrally connected by a web portion 36. The sprocket 4 is securely fastened to the camshaft 2 by any suitable fastening means, such as friction fit, weldment, splines or keyways. A chain 10 (illustrated in FIG. 3) is disposed on teeth 18 of sprocket 4.

The inertia ring 6 has an outer periphery 20 that is substantially circular but interrupted by a gap 22. The inertia ring 6 has a central opening 24 that is essentially circular. The circularity is interrupted by one or more cut-out areas 12 communicating with the central opening 24. The number, shape, size and placement of the cut-out areas 12 affect the moment of inertia of the inertia ring 6 and can be adjusted to tune the damping effect. The damping effect can further be tuned by changing the diameter of the inertia ring 6 and the radius at which the frictional material 16 is placed.

Figure 3:
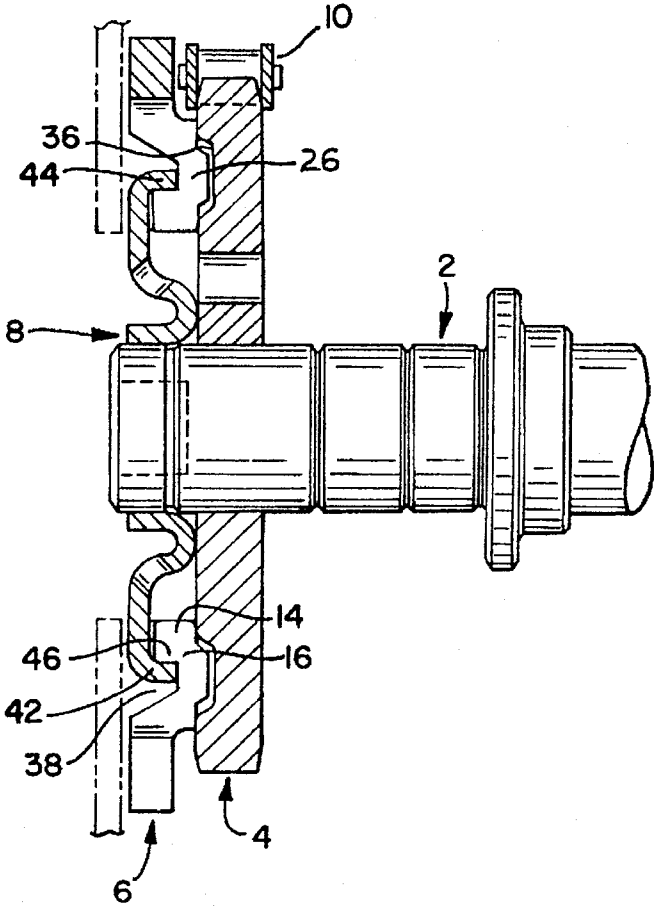
FIG. 3 is a sectional view taken along line 3—3 in FIG. 2, illustrating the damper assembled on the camshaft.
Figure 2:
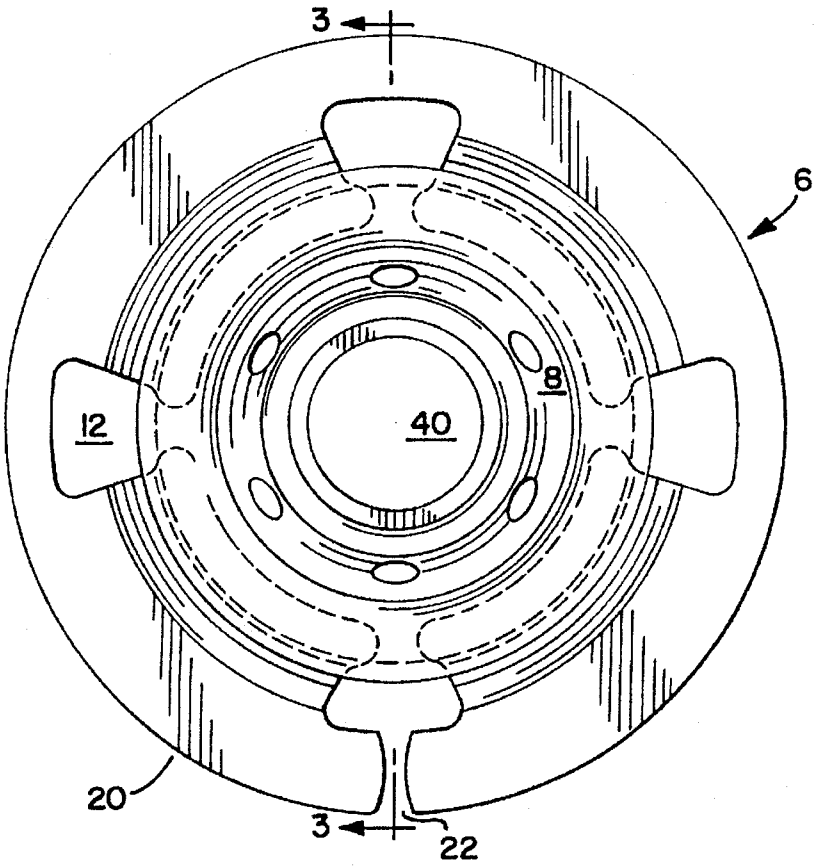
FIG. 2 is a plan view of the embodiment shown in FIG. 1, illustrating the assembled damper.

In the preferred embodiment illustrated in FIGS. 2–3, the inertia ring 6 is formed of steel and has a raised annular surface 26 adapted to fit adjacent web portion 36 of the sprocket 4. On the opposite face of the inertia ring 6 is an annular trough 38. An inner annulus 14 forms the boundary proximate the camshaft 2 of the annular trough 38. The inner annulus 14 has a first contact face 46 coaxial with the camshaft and located on the radially distant side of the inner annulus 14.

The hub member 8 is made of steel and has an opening 40 adapted to receive the camshaft 2. A cross-section of a radius of the hub member 8 is shaped essentially like the numeral "5" or the letter "S" and will be referred to herein as "S-shaped" to avoid confusion with the numbered parts. The leg of the "S" located distally from the opening 40 is outer annulus 42. The outer annulus 42 has a second contact face 44 coaxial with the camshaft and located on the radially proximate side of said outer annulus 42. The hub member 8 is press fit onto the camshaft or otherwise maintained on the camshaft.

A circular belt of frictional material 16 may be disposed on the first contact face 46 of the inner annulus 14 or on the second contact face 44 of the outer annulus 42 of the hub member 8. The frictional material 16 may be any conventionally used clutch facing or like product having a stable coefficient of friction and good service life characteristics. It is secured to the selected contact face by any suitable means, preferably by an adhesive.

In operation, the inertia ring 6 and the hub member 8 slide with respect to one another. Rotation of the camshaft 2 causes the gap 22 of the inertia ring 6 to spread open wider, forcing the second contact face 44 of the inertia ring 6 more firmly against the frictional material 16 and the first contact face 46 of outer annulus 42 of hub member 8. Vibrations of the sprocket 4 and the camshaft 2 are damped by heat dissipation from the rotational sliding action of the inertia ring 6 and the hub member 8 along the frictional material 16.

Figure 5:
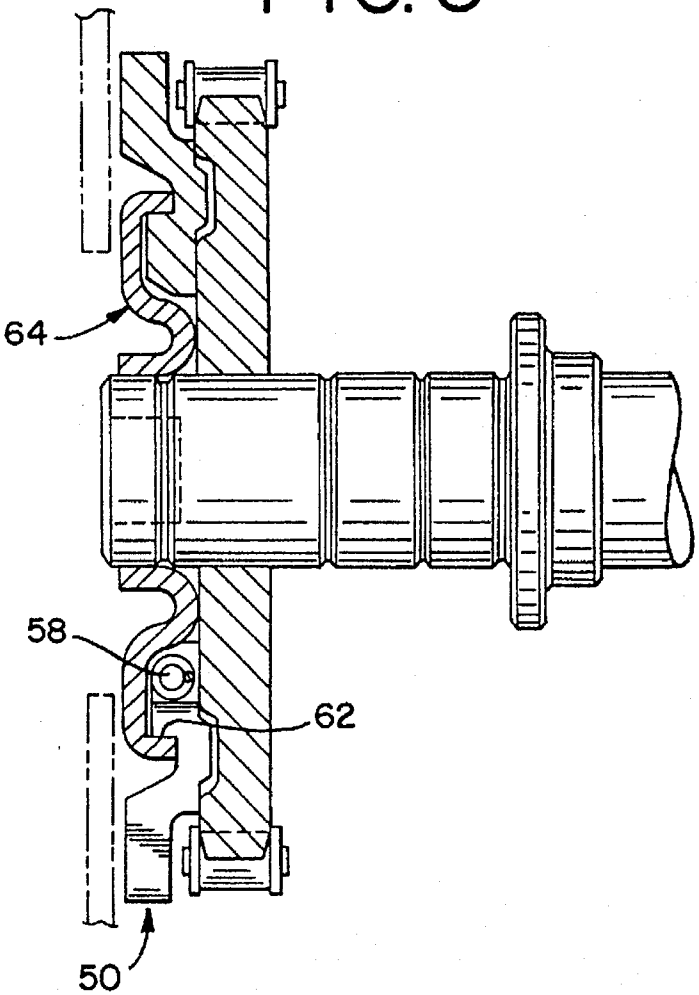
FIG. 5 is a sectional view taken along line 5—5 of the embodiment of FIG. 4, illustrating the damper assembled on the camshaft.
Figure 4:
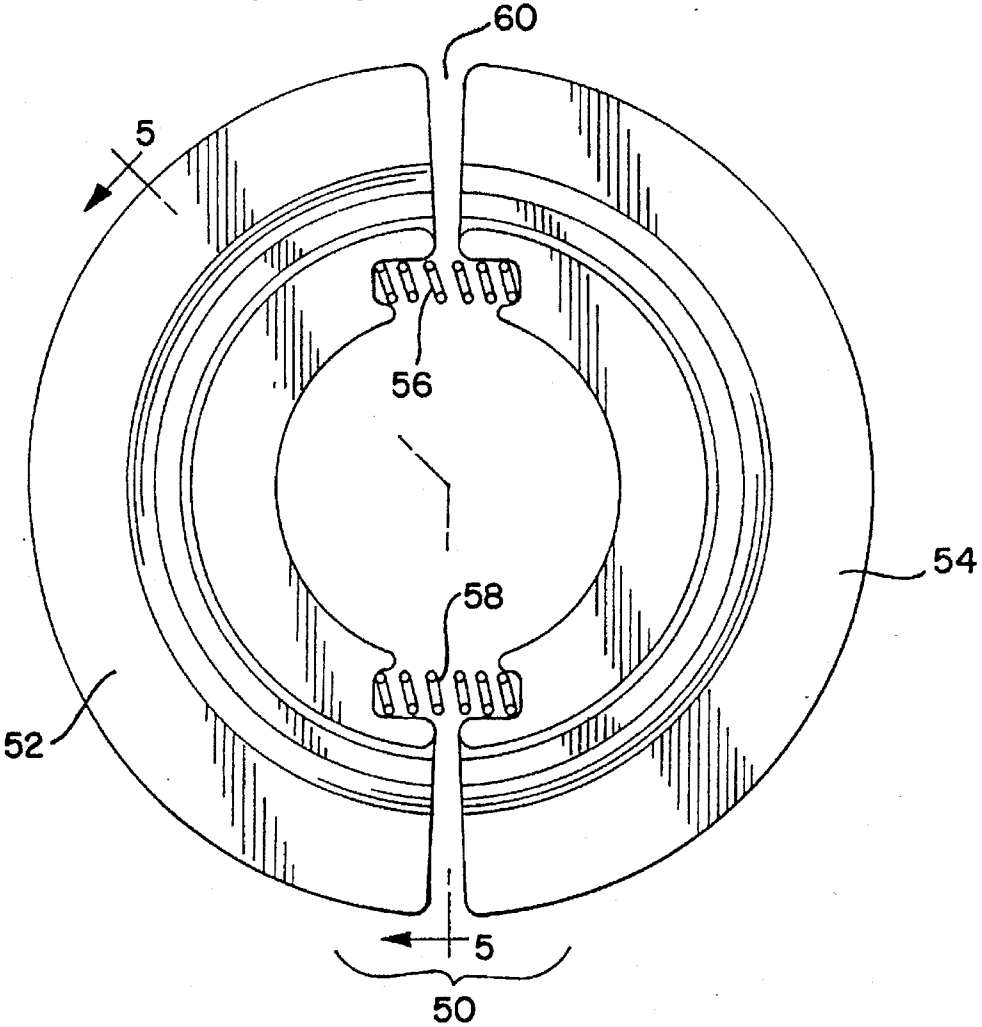
FIG. 4 is a plan view of a second embodiment of a centrifugal force vibration damper assembly, illustrating the two portions of the inertia ring in this embodiment.

A second embodiment is illustrated in FIGS. 4 and 5. In this embodiment, the inertia ring 50 is split into a first section 52 and a second section 54 which are connected by at least one spring member 56. In a preferred embodiment, a second spring member 58 is used, although another resilient connector (not shown) could be used in its place. In this embodiment, a gap 60 extends across the diameter of the inertia ring 50 between the first section 52 and the second section 54.

During rotation of the centrifugal force vibration damper assembly, the gap 60 widens, as the first section 52 moves away from the second section 54. As in the first embodiment, the spreading of the inertia ring 50 exerts force on frictional material 62 positioned between the inertia ring 50 and the hub member 64. Spring member 56 provides a preload force on the frictional material 62. Vibrations are damped as heat is dissipated from the inertia ring 50 and the hub member 64 sliding along the frictional material 62. In this embodiment, tuning can further be accomplished by selecting the preload force of the spring.

Figure 7:
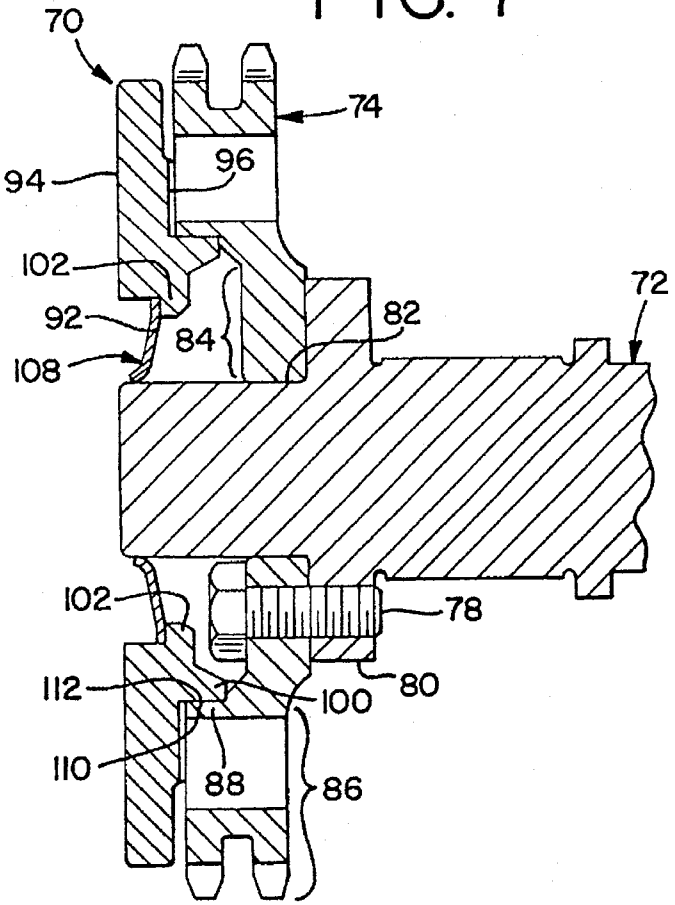
FIG. 7 is a sectional view taken along line 7—7 in FIG. 6, illustrating the damper assembled on the camshaft.
Figure 6:
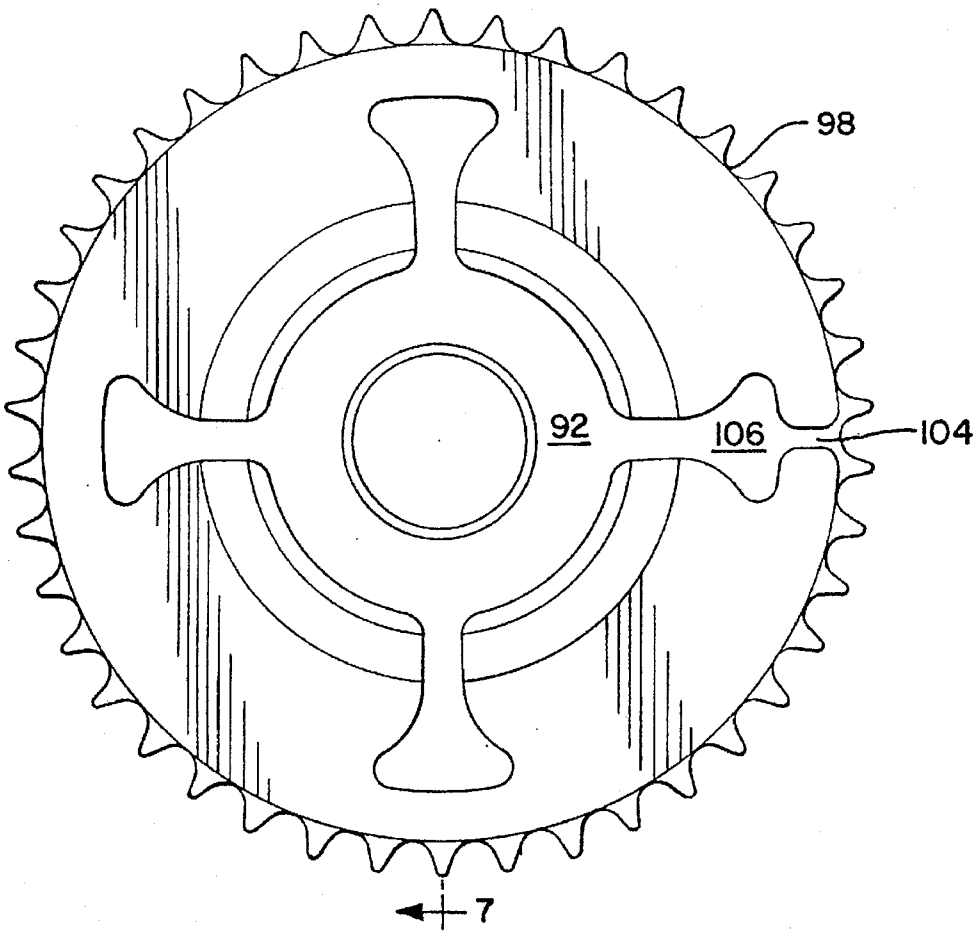
FIG. 6 is a plan view of a third embodiment of a centrifugal force vibration damper assembly.

In another embodiment illustrated in FIGS. 6 and 7, an inertia ring 70 is positioned on a camshaft 72 adjacent a sprocket 74 and held in place by a retaining ring 108. A bolt 78 attaches the sprocket 74 to an annulus 80 on the camshaft 72. The sprocket 74 has a camshaft-receiving opening 82, a recessed region 84, and a rim portion 86. The rim portion 86 has a first contact face 88 perpendicular to the recessed region 84 and coaxial with the camshaft 72.

Inertia ring 70 has a central opening 92, an exterior face 94, an interior face 96, an outer periphery 98 and an annular projection 100 having a second contact face 112 perpendicular to interior face 96. The second contact face 112 of annular projection 100 is adapted to fit adjacent the first contact face 88 of the rim portion 86. The central opening 92 is defined by an annular lip 102. The outer periphery 98 of the inertia ring 70 is substantially circular yet pierced by a gap 104 extending radially outward from the central opening 92.

At least one cut-out area 106 contiguous with the central opening 92 is provided. Positioned on camshaft 72 adjacent the inertia ring 70 is a retaining ring 108 that is in contact with the annular lip 102 of inertia ring 70. A frictional material 110 may be disposed on the first contact face 88 of the rim portion 86 of sprocket 74 or on the second contact face 112 of the annular projection 100 of the inertia ring 70.

During rotation, the gap 104 of inertia ring 70 spreads apart and the second contact face 112 of the inertia ring 70 presses against the first contact face 88 of sprocket 74. The inertia ring 70 slides with respect to sprocket 74 along frictional material 110 and vibrations are absorbed from the camshaft 72 through heat dissipation.

While several embodiments of the invention are illustrated, it will be understood that the invention is not limited to these embodiments. Those skilled in the art to which the invention pertains may make modifications and other embodiments employing the principles of this invention, particularly upon considering the foregoing techniques.

What is claimed is:

1. A centrifugal force vibration damper assembly to absorb vibrations in a camshaft and sprocket system, comprising:

a sprocket positioned along a camshaft, said sprocket having a rim portion, said rim portion having a first contact face coaxial with the camshaft, an inertia ring positioned along said camshaft adjacent said sprocket, said inertia ring having an outer periphery, a central opening and an annular projection adapted to fit inside said rim portion, said central opening extending radially outward through said outer periphery of said inertia ring to form a gap in the outer periphery of said inertia ring, said annular projection having a second contact face coaxial with the camshaft, a retaining ring concentrically positioned around said camshaft adjacent said inertia ring and in contact with said inertia ring, and a frictional material interposed between the first contact face and the second contact face.

2. The centrifugal force vibration damper assembly of claim 1 wherein said frictional material is attached to the first contact face.

3. The centrifugal force vibration damper assembly of claim 1 wherein said frictional material is attached to the second contact face.

4. The centrifugal force vibration damper assembly of claim 1, wherein said inertia ring further comprises a cut-out area contiguous with said central opening.

5. The centrifugal force vibration damper assembly of claim 4 wherein said cut-out area is generally triangular in shape.

* * * * *